United States Patent [19]

Rubens

[11] Patent Number: 4,626,660

[45] Date of Patent: Dec. 2, 1986

[54] OVEN HAVING CAVITIES OF VARYING TEMPERATURE

[75] Inventor: Louis C. Rubens, Midland, Mich.

[73] Assignee: The Dow Chemical Company, Midland, Mich.

[21] Appl. No.: 725,890

[22] Filed: Apr. 22, 1985

[51] Int. Cl.[4] ..... F27D 11/00

[52] U.S. Cl. ..... 219/385; 219/432; 219/433; 219/435; 219/521

[58] Field of Search ..... 219/385, 386, 387, 432, 219/433, 435, 521

[56] References Cited

U.S. PATENT DOCUMENTS

| | | | |
|---|---|---|---|
| 3,109,084 | 9/1963 | Walsh | 219/385 |
| 4,044,226 | 8/1977 | Kadlecik et al. | 219/521 |
| 4,206,345 | 6/1980 | Maass et al. | 219/386 |
| 4,342,903 | 8/1982 | Hoogstock | 219/433 |

*Primary Examiner*—Nicholas P. Godici
*Assistant Examiner*—Karen Skillman
*Attorney, Agent, or Firm*—R. B. Ingraham

[57] ABSTRACT

An oven is provided which has varying temperature zones. The oven is prepared from a pair of opposed elongate metal members, each heated at adjacent ends and a cavity defining a thermally insulating member between the metal bar.

7 Claims, 3 Drawing Figures

OVEN HAVING CAVITIES OF VARYING TEMPERATURE

Oftentimes in the process of research and development it is desirable to evaluate the behavior of substances at various temperatures. Frequently this is done by exposing the substances in air at varying temperatures. Generally, such a procedure utilizes an air oven and for each temperature desired the temperature control of the oven must be adjusted and sufficient time allowed for the oven to come to equilibrium. Such a procedure when a single oven is employed can be quite time consuming.

It would be desirable if there were available an improved oven which would simultaneously provide a range of temperatures for the evaluation of products.

It would also be desirable if such an oven were of simple construction.

It would also be desirable if such an oven occupies relatively little space.

These benefits and other advantages in accordance with the present invention are achieved in an oven assembly capable of providing zones of different temperature, the assembly comprising first and second elongate members of generally like dimension, each of the members having at least one planar face of generally like dimension, each of the elongate members having a first end and a second end, each of the first ends having a heat source; the heat source being capable of supplying like amounts of heat to the first ends of the elongate members; a thermally insulating member of elongate generally rectangular configuration having opposed generally parallel faces, the elongate thermally insulating member having defined thereon a plurality of openings in spaced apart relationship extending between the parallel faces of the insulating member, the openings being adapted to receive samples of material to be evaluated at varying temperatures; the insulating member being positioned between the planar faces of the elongate members the first ends of the elongate members being adjacent and the second ends of the elongate members being adjacent.

Figure 1:
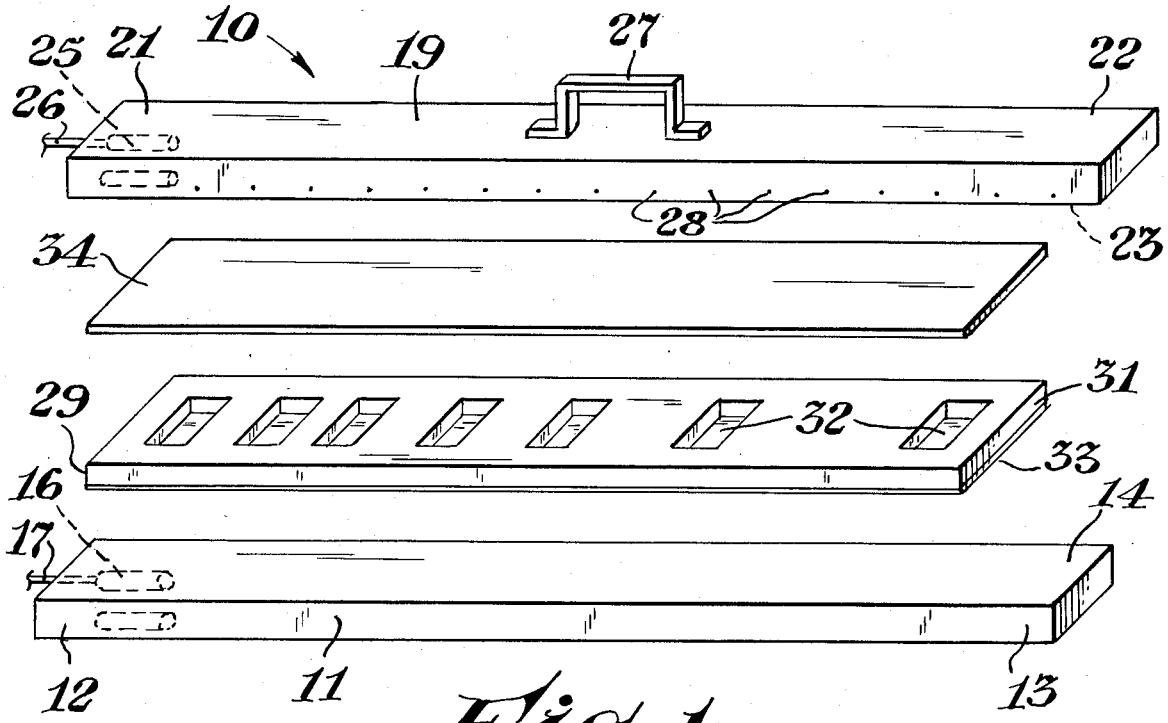
Figure 2:
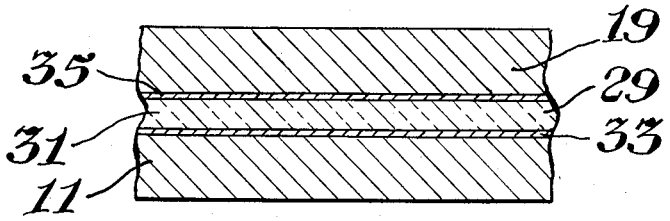
Figure 3:
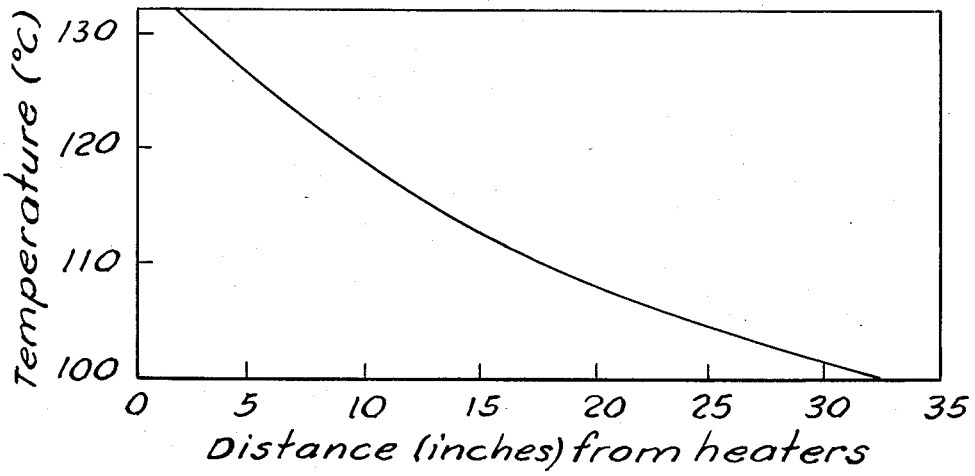

Further features and advantages of the present invention will become more apparent from the following specification taken in connection with the drawing wherein FIG. 1 is a schematic isometric exploded view of an oven in accordance with the present invention generally designated by the reference numeral 10;

FIG. 2 is a fractional side view of an oven such as the oven 10 in the closed position; and FIG. 3 is a graph showing oven temperatures along the length thereof.

In FIG. 1 there is depicted an isometric schematic exploded view of an oven in accordance with the present invention generally designated by the reference numeral 10. The oven 10 comprises in cooperative combination a first elongate member 11. The elongate member 11 as depicted in the FIG. 1 is a rectangular elongate bar having a first end 12 and a second end 13. The member or bar 11 has a planar working surface 14. The surface 14 is upwardly facing. Disposed within the end 12 of the bar 11 is an electric cartridge heater 16 having inlets 17. The oven 10 has a second bar like member 19. The member 19 has a first end 21 and a second end 22. The member 19 is of generally like dimensions as the member 11 and has a downwardly disposed working face 23 of generally like dimension to the face 14 of bar 11. A cartridge heater 25 is disposed within the first end 21 of the member or bar 19 and has power lead 26. A handle 27 is affixed to the member 19 in a generally central location and at a location remote from the working face 23. A plurality of holes 28 are drilled in the member 19 at spaced apart locations parallel to and adjacent the working face 23. The holes extend generally normally to the longitudinal axis of the member 19.

A laminate cavity defining plate 29 is disposed between the members 11 and 19. The laminate comprises a first layer 31 of a synthetic resinous foam. The foam is selected such that it is stable at the desired operating temperature. Polyisocyanurate foams for example are satisfactory for the investigation of foaming characteristics of most styrene polymers. The isocyanurate layer 31 defines a plurality of sample receiving cavities generally designated by the reference numeral 32. Adhered to the layer 31 is a layer 33. The layer 33 is desirably of a thermoconductive material such as aluminum. The layer 33 advantageously is aluminum foil. The cavity defining means 29 advantageously has a width about equal to the width of the members 19 and 11 and a length which approximates the length of the members 19 and 11. An unadhered foil 33 is disposed over the openings 32.

FIG. 2 is a fractional side view of an oven in accordance with the present invention wherein an unadhered layer 35 of thermally conductive metal foil has been disposed between the bar 19 and the insulating layer 31. In operation of an oven in accordance with the present invention, the components are assembled in the manner indicated in FIG. 2 wherein bar 11 contacts the layer 33, which in turn is adhered to the insulating material 31. The insulating material 31 is then covered with a thermally conductive foil 35 and the bar 19 placed above it.

The oven advantageously is supported at either end by small pedestals and usually at a distance of about 6 inches above conventional laboratory work bench height. Power is applied to the cartridge heaters such as heaters 16 and 25, and the bars are allowed to come to equilibrium within ambient conditions. Thermocouples in the drilled holes 28 provide information as to the temperature at various locations along the bar and are readily plotted as is shown in FIG. 3. The temperature curve was derived using bar members measuring 36 inches in length and having a thickness of 1½ inches and a width of 2½ inches. The 2½ inches surfaces were used as working surfaces. The insulating layer was a polyisocyanurate foam having a thickness of 0.625 inch with aluminum foil laminated to one surface. The heaters employed each were rated at 100 watts.

Employing the graph of FIG. 3, a plurality of sample receiving cavities were cut into the insulating member to provide chambers which differed from adjacent chambers by 5 degrees centigrade. Such an oven provides a very convenient means of evaluating foaming characteristics of expandable polymers such as polymers of styrene and polymers of ethylene. The sample cavities were 1.375 inches by 2 inches and the foam was removed without removing adjacent aluminum foil.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. An oven assembly capable of providing zones of different temperature, the assembly comprising first and second elongate members of generally like dimension, each of the members having at least one planar face of generally like dimension, each of the elongate members having a first end and a second end, each elongated member having a heat source only at its first end; the heat source being capable of supplying like amounts of heat to the first ends of the elongate members and creating zones of diminishing temperatures from its first to its second end; a thermally insulating member of elongate generally rectangular configuration having opposed generally parallel faces, the elongate thermally insulating member having disposed thereon a plurality of openings in spaced apart relationship extending between the generally parallel faces of the insulating member, the openings being adapted to receive samples of material to be evaluated at varying temperatures; the insulating member being positioned between the planar faces of the elongate members, the first ends of the elongate members being adjacent and the second ends of the elongate members being adjacent.

2. The oven assembly of claim 1 wherein the elongate members are metal.

3. The oven assembly of claim 2 wherein the heat sources are cartridge heaters disposed within the first ends of the elongate members.

4. The oven assembly of claim 1 wherein the elongate members are rectangular aluminum bars.

5. The oven assembly of claim 1 wherein the insulating member is a synthetic resinous foam.

6. The oven assembly of claim 5 wherein the insulating member has affixed to a major face thereof a metal foil.

7. An oven assembly capable of providing zones of different temperature, the assembly comprising first and second aluminum elongate members of rectangular cross section and like dimension, each of the members having matching faces of like dimension; each of the elongate members having a first end and a second end; each elongate member having an electrical cartridge heater only at its first end, the cartridge heaters adapted to supply like amounts of heat to the first ends of the elongate members and creating zones of diminishing temperatures from its first to its second end; a synthetic resinous foam thermally insulating member having opposed generally parallel faces, length and width approximating the matching faces of the first and second elongate members, the insulating member defining a plurality of openings in a direction normal to its major axis and extending between opposed faces of the elongate members, an aluminum foil laminated to a face of the insulating member to thereby close one end of each opening; with the further limitation that the first ends of the elongate members are adjacent and the second ends of the elongate members are adjacent.

* * * * *